United States Patent [19]

Kiriake et al.

[11] Patent Number: 4,845,937

[45] Date of Patent: Jul. 11, 1989

[54] BOBBIN TRANSFER SYSTEM

[75] Inventors: Masaharu Kiriake, Uji; Shoichi Tone, Kyoto, both of Japan

[73] Assignee: Murata Kikai Kabushiki Kaisha, Kyoto, Japan

[21] Appl. No.: 190,636

[22] Filed: May 5, 1988

[30] Foreign Application Priority Data

| | | | |
|---|---|---|---|
| May 9, 1987 | [JP] | Japan | 62-113171 |
| May 12, 1987 | [JP] | Japan | 62-115420 |
| Aug. 4, 1987 | [JP] | Japan | 62-195004 |

[51] Int. Cl.[4] ..... D01H 9/18; D01H 9/02

[52] U.S. Cl. ..... 57/281; 57/274; 57/266; 242/35.5 A; 242/35.5 R

[58] Field of Search ..... 57/274, 276, 281, 266, 57/268, 270, 275; 242/35.5 A, 35.5 R

[56] References Cited

U.S. PATENT DOCUMENTS

| | | | |
|---|---|---|---|
| 3,132,463 | 5/1964 | Glastra et al. | 57/274 |
| 3,791,125 | 2/1974 | Kawakami | 57/274 |
| 3,828,682 | 8/1974 | Klein | 57/281 X |
| 4,023,339 | 5/1977 | Laderbach et al. | 57/281 X |
| 4,181,228 | 1/1980 | Hashimoto et al. | 242/35.5 R X |
| 4,432,198 | 2/1984 | D'Agnolo | 242/35.5 R X |
| 4,541,578 | 9/1985 | Kawarabashi et al. | 242/35.5 A |
| 4,561,243 | 12/1985 | Gaudino | 57/274 |
| 4,660,368 | 4/1987 | Küpper | 242/35.5 R X |

*Primary Examiner*—Donald Watkins

*Attorney, Agent, or Firm*—Spensley Horn Jubas & Lubitz

[57] ABSTRACT

A bobbin transfer system consisting of a pair of conveyors, one to carry the spinning bobbins and the other to carry the empty bobbins, each installed at a top portion of a spinning machine to run along the spindle row. The spinning machine and a winder may be connected with each other by the conveyors.

20 Claims, 8 Drawing Sheets

BOBBIN TRANSFER SYSTEM

FIELD OF THE INVENTION

The present invention relates to a bobbin transfer system for a spinning machine and a winder.

RELATED ART STATEMENT

Various types of transfer systems have been developed to transfer spinning bobbins which are produced by a spinning machine to a winder for the subsequent process or return empty bobbins discharged from a winder back to a fine spinning machine.

Some types of conventional bobbin transfer systems convey a large number of bobbins, put in a bobbin box either randomly or in order from the spinning machine to the winder. Also, in the prior art there are other bobbin transfers of the spinner-winder type which includes a conveyor to directly connect the fine spinner and winder. One example of such systems of the fine spinner-winder type is disclosed in published Japanese patent application No. 56-37 137.

Those prior art bobbin transfer systems have been found to pose various problems. For example, the wound yarn layer of the bobbin has tended to fluff out in contact with one another. In addition, a spinning machine has to have a transfer band of greater space which runs along the machine. Furthermore, as to thick yarns for extremely thick carpet or blanket, the bobbins have to be large in size, measuring 40 to 60 cm, too large to obtain easy access to the spindle, particularly in bobbin transfer systems of the type in which bobbins are arrayed in front of the spinning machine.

OBJECT AND SUMMARY OF THE INVENTION

It is an object of the present invention to provide a bobbin transfer system in which floor space for the transfer of bobbins can be spared and easy access to spindles can be attained.

The present invention is a bobbin transfer system which consists of a pair of conveyors, one to carry the spinning bobbins and the other to carry the empty bobbins, each installed at a top portion of the spinning machine to run along the spindle row.

In the present invention, a spinning machine and a winder may be connected with each other by a closed loop consisting of a spinning bobbin transfer passage and an empty bobbin transfer passage.

DETAILED DESCRIPTION OF PREFERRED EMBODIMENTS

Preferred embodiments of the present invention will be described in detail in conjunction with the accompanying drawings.

Figure 1:
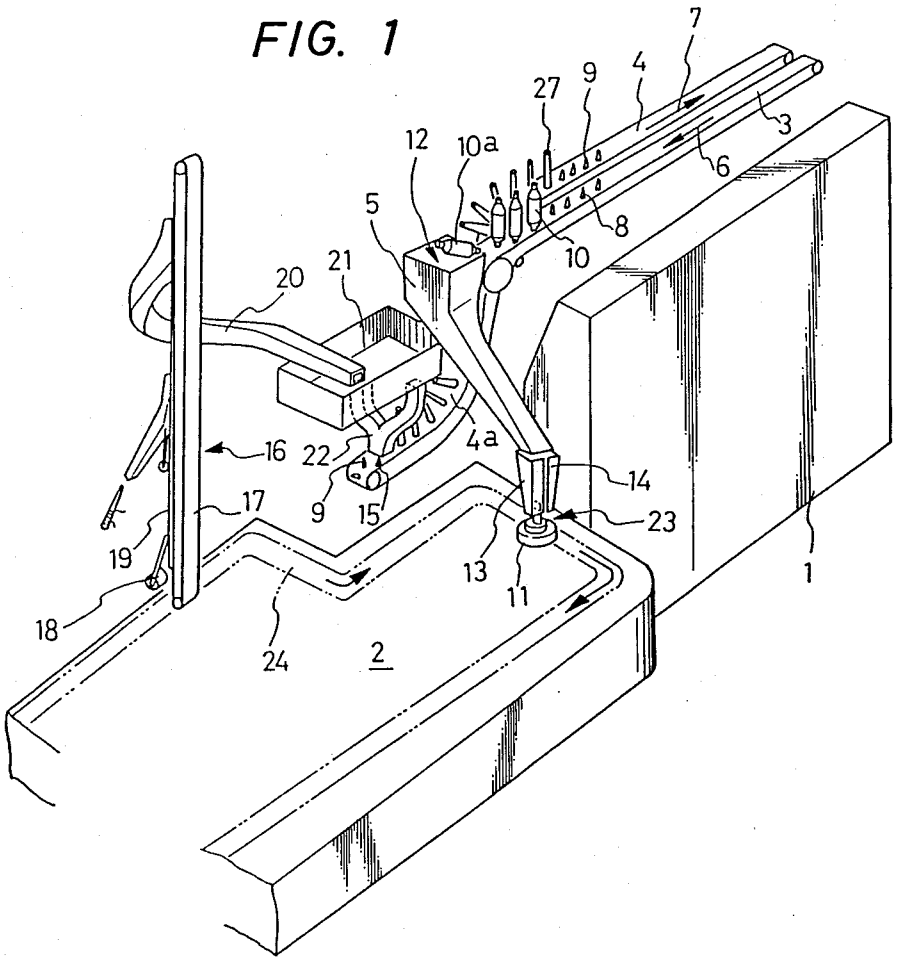
FIG. 1 is a perspective view showing the overall structure of the bobbin transfer system according to the present invention.

Referring to FIG. 1, a spinning machine 1 includes a connective portion with a preparatory station 2 designed to set work ready for the subsequent stage of winding. Also, the spinning machine carries at a top portion thereof a pair of a spinning bobbin conveyor 3 and an empty bobbin conveyor 4, each installed to run along a row of spinning spindles. In operation, the spinning bobbin conveyor moves in a stepping manner in the direction of the arrow 6 toward a chute 5. The empty bobbin conveyor 4, on the other hand, advances stepwise in the direction of the arrow 7. Each of the conveyors 3 and 4 carries therein a row of pegs 8, 9, spaced along the longitudinal length in line with the spacing of the spinning spindles, each adapted to hold a spinning or empty bobbin which is fitted onto the peg when conveyed.

The chute 5 installed at a winder-side end of the spinning bobbin conveyor 3 is provided to receive spinning bobbins 10 from the spinning bobbin conveyor 3 to transfer them to a bobbin transfer tray 11. The chute 5 has a receiving port 12 opened at a top end thereof that is so situated to the point of turning of the spinning bobbin conveyor 3 that the spinning bobbin falls straight into the receiving port as it is unloaded from the peg. Also, the chute 5 has an exit port opened at a bottom end thereof and a pair of bobbin guides 13 and 14 mounted below the exit port and adapted to open in a direction perpendicular to the direction to which the tray 11 transfers a bobbin.

The empty bobbin conveyor 4 includes at a winder-side end thereof an inclined portion **4*a* that extends downwardly from the conveyor to reach a point 15** where the conveyor receives empty bobbins.

The preparatory station 2 has an empty bobbin extracting device 16 to pull out empty bobbins from the tray. The empty bobbin extracting device 16 comprises a conveyor belt 17 and a swinging roller 18. The conveyor belt is an endless belt and moves to carry in a vertical direction. The swinging roller swings in a direction perpendicular to the tray-transferring direction. In operation, when an empty bobbin, integrally carried with the tray, arrives at a point where it is pulled off from the tray, it is lifted up between the conveyor belt 17 and a nip plate 19 and is allowed to drop down in an empty bobbin chute 20, which opens at a bottom end thereof into an empty bobbin tank 21.

To the bottom of the empty bobbin tank 21 is connected a chute 22, which opens at a lower end thereof above the inclined portion **4*a* of the conveyor with the pegs 9. It is so designed that the chute 22 drops the empty bobbins when it receives from the tank one at a time so that the pegs 9 receive them when they move into the receiving point below the lower end of the chute 22**.

With the above arrangement, the empty bobbins discharged by the winder are carried integrally with the tray 11 and removed from the tray by the empty bobbin extracting device 16. The tray, after unloading the empty bobbins, continues on following a transfer path 24 to a spinning bobbin receiving position 23. When the tray reaches the spinning bobbin receiving position 23, detector means capable of detecting a tray such as a photoelectric sensor, which may be mounted at a lower end of the paired bobbin guides 13 and 14, sends a signal which in turn causes the spinning bobbin conveyor 3 to move a predetermined spacing in the direction of the arrow 6 so that the bobbin 10*a* at the leading end of the conveyor is allowed to drop from its peg through the chute 5 and the paired bobbin guides 13 and 14 onto the tray 11 which receives the bobbin fittingly in position.

Figure 2:
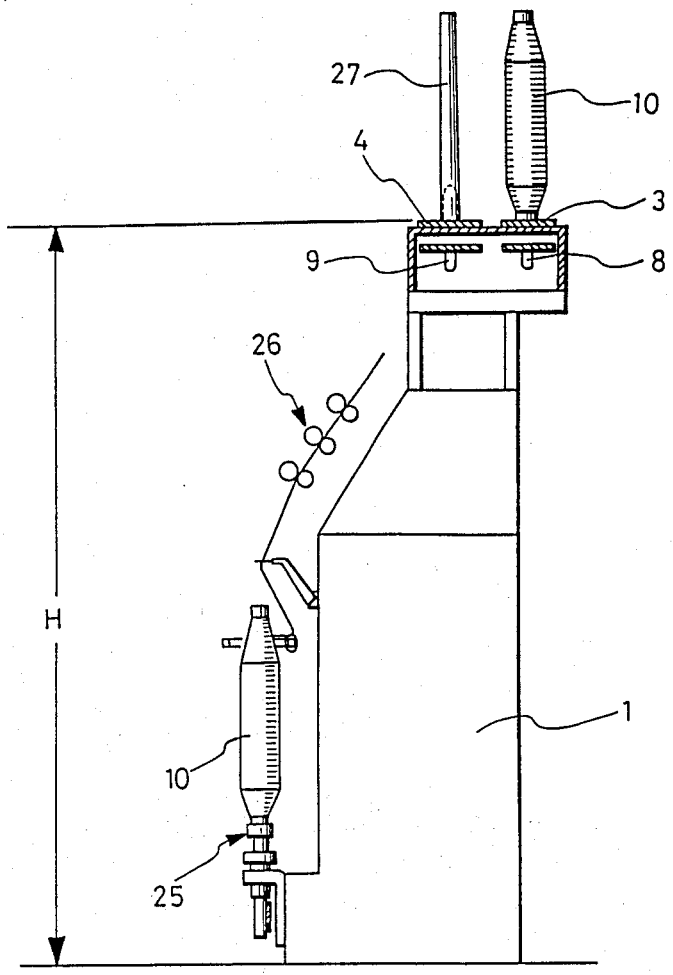
FIG. 2 is a side view of a spinning machine.

FIG. 2 shows a side view of the spinning machine. The spinning machine has a plurality of spindles 25 that are arrayed in a direction perpendicular to the plane of the drawing shown. In operation, the staple fiber bundle fed from a row of draft rollers 26 is twisted and wound on a bobbin 10 as it is rotated by the spindle 25. When the bobbin 10 is wounded with a predetermined length of yarn, it is doffed up over a distance H either by a doffer or by an operator to the spinning bobbin conveyor 3. The spindle 25, after unloading from the empty bobbin conveyor 4 either by a doffer or by an operator.

Figure 3:
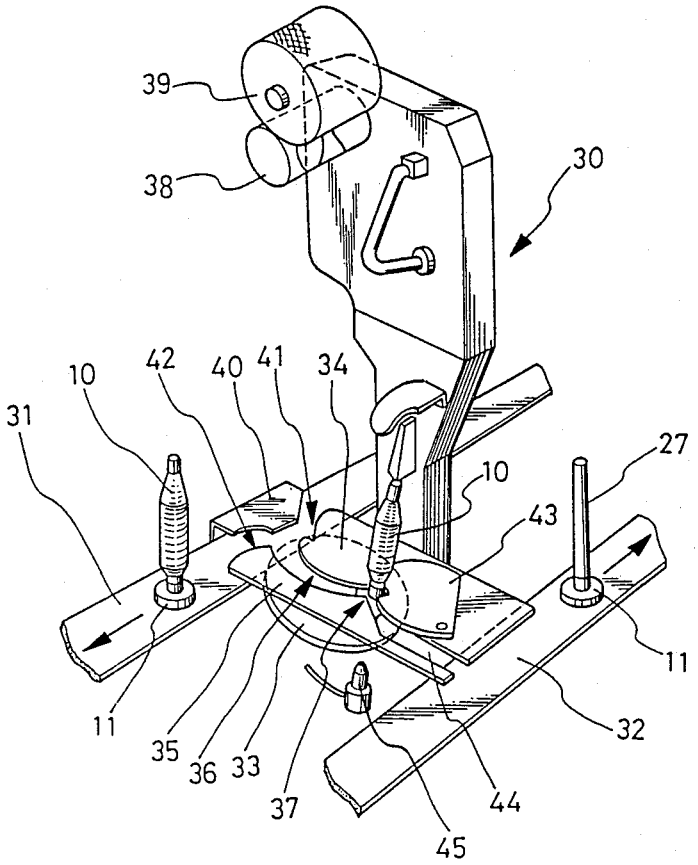
FIG. 3 is a perspective view showing an example of a winding unit.

FIG. 3 shows a winding unit which re-winds a spinning bobbin produced by the spinning machine. Normally, a winder comprises a plurality of such winding units.

The winding unit 30 is installed between a pair of a spinning bobbin conveyor 31 to carry spinning bobbins and an empty bobbin conveyor 32 for empty bobbins. Between the paired conveyors 31 and 32 is provided a tray transfer passage 36 composed of a rotary disc 33 and a pair of guide plates 34 and 35. When a spinning bobbin 10, carried by the rotary disc 33 in rotation about its center, reaches a take-up position 37, the yarn begins to unwind from the spinning bobbin 10 and is then re-wound on a package 39 as the package is rotated by a traverse drum 38. A stationary guide plate 40 is mounted along the spinning bobbin conveyor 31 at a point adjacent to each winding unit and provided to guide a spinning bobbin from the conveyor to automatically take into the tray transfer passage 36 through an entrance 41 only when there is space for in the passage 36. So long as the passage 36 is full of a predetermined number of spinning bobbins, the stationary guide plate causes every spinning bobbin coming through the entrance to move out from an exit 42 to the next winding unit. The empty bobbin 27, after being finished the winding at the take-up position 37, is ejected into a discharge path 44 and then onto the empty bobbin return line 32 by discharging means such as an ejecting lever 43. The numeral 45 largely designates a yarn blowing nozzle. With the above arrangement, the system functions in the same manner as the embodiment described in association with FIG. 1 in which each time an empty bobbin is extracted and placed onto the empty bobbin conveyor, an empty tray is transferred to the bobbin receiving position where it receives a spinning bobbin 10. Also, substantially at the moment when a spinning bobbin, completed on the spinning machine, is doffed, an empty bobbin is reinstalled at the spindle.

The another embodiment of the present invention is a bobbin transfer system comprising a closed loop for transferring bobbins between a spinning machine and a winder. The closed loop consists of a pair of spinning bobbin transfer passage and empty bobbin transfer passage each mounted at a top portion of the spinning machine. This embodiment will be described in detail in conjunction with the accompanying drawing.

Figure 4:
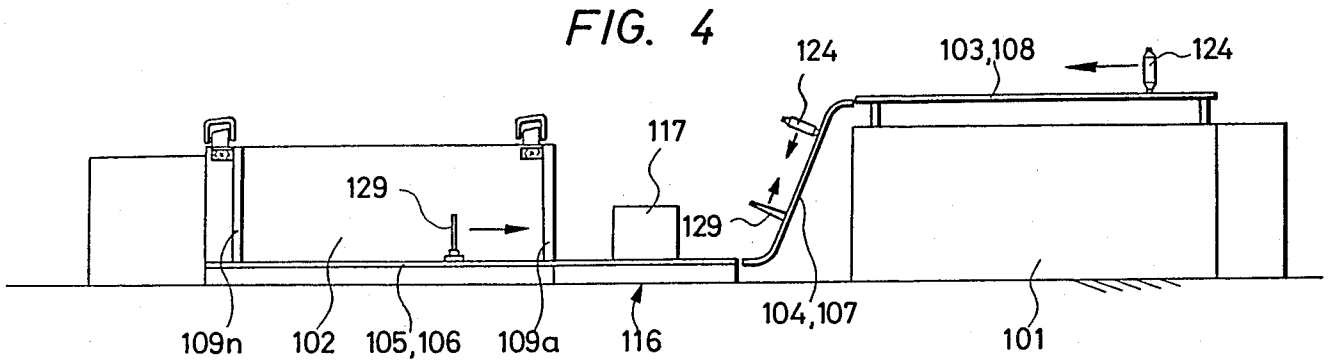
FIG. 4 is a front view showing the layout of another embodiment according to the present invention.
Figure 5:
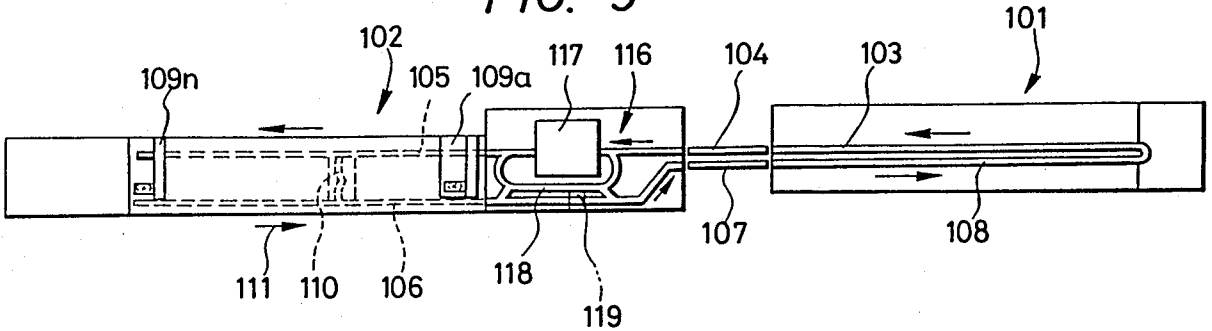
FIG. 5 is a plan view showing the layout of the embodiment of FIG. 4.

Referring first to FIGS. 4 and 5, a spinning machine 101 and a winder 102 are mounted side by side. Between the spinning machine 101 and the winder 102 are installed a closed loop for transferring bobbins comprised of spinning bobbin transfer passages 103, 104 and 105 for spinning bobbins and empty bobbin transfer passages 106, 107 and 108 for empty bobbins. In the region of the spinning machine 101, the empty bobbin transfer passage 108 and the spinning bobbin transfer passage 103 extend along a row of spindles above the spinning machine. Both passages are connected to each other at one end of the spinning machine. At the opposite winder-side end of the spinning machine the empty bobbin transfer passage 108 is joined to an upper end of the empty bobbin transfer passage 107 that is inclined downward. Also, the spinning bobbin transfer passage 103 has its opposite end connected to an upper end of the spinning bobbin transfer passage 104 that is also inclined downward.

Also, in the region of the winder 102 the spinning bobbin transfer passage 105 and the empty bobbin transfer passage 106, mounted below the winder, extend along a row of winding units 109*b* . . . , 109*n* at a level above the floor. Each of the winding units has between the spinning bobbin transfer passage 105 and emtpy bobbin transfer passage 106 a spinning bobbin passage 110. Each crossing passage 110 includes means to guide a spinning bobbin 124 as it arrives at the passage on the spinning bobbin transfer passage 105 to take ino the passage 110, as will later be described, where the bobbin is re-wound at the re-winding position. Then, the bobbin, now as an empty bobbin, is ejected onto the empty bobbin transfer passage 106, and is carried in the direction of the arrow 111 toward the spinning machine by the empty bobbin transfer passage 106.

The spinning bobbin transfer passage 105 is joined on its spinning machine side to the lower end of the inclined spinning bobbin transfer passage 104. Also, the empty bobbin transfer passage 106 is connected on its spinning machine side to the lower end of the inclined empty bobbin transfer passage 107.

With the above arrangement, every spinning bobbin 124 produced by the spinning machine, carried along the spinning bobbin transfer passages 103, 104 and 105, is taken into the passage 110 in one of the winding units, and, as an empty bobbin, returned along the empty bobbin transfer passages 106, 107 and 108 forming a closed loop with the passages for spinning bobbins.

Figure 6:
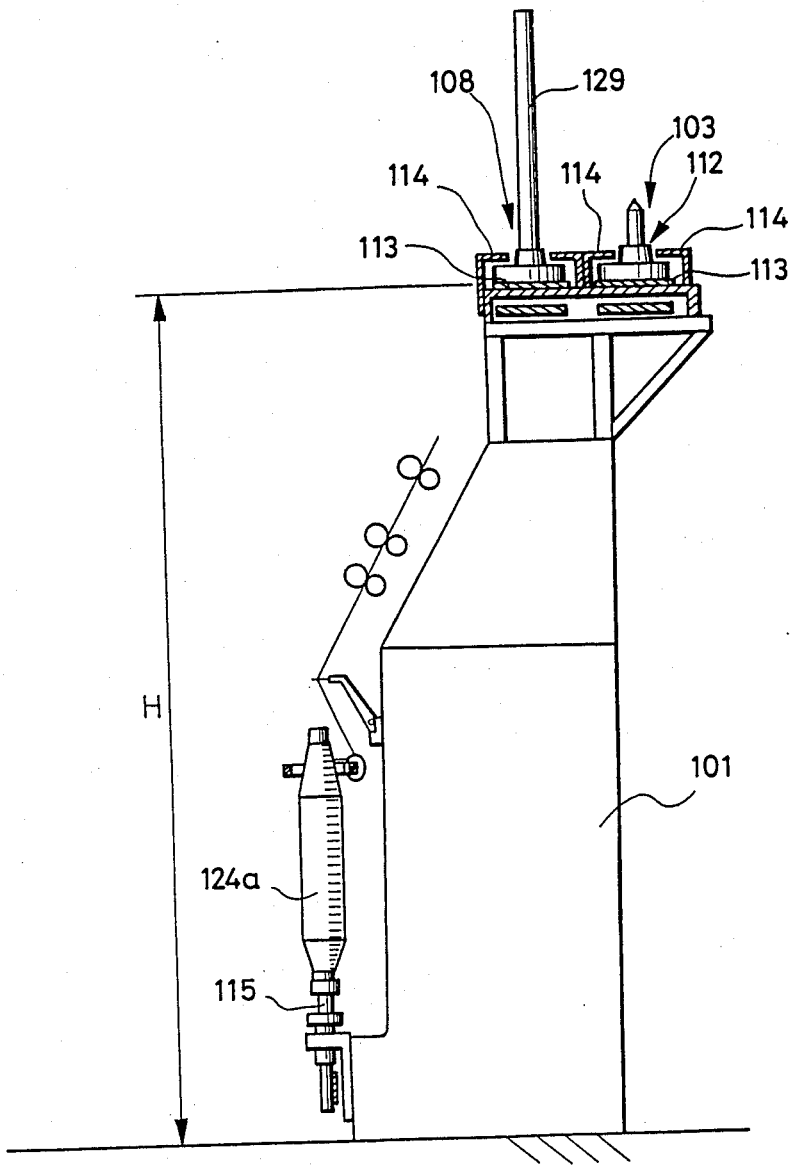
FIG. 6 is a side view of the bobbin transfer passages on the side of the spinning machine.

In this particular embodiment, the spinning bobbin 124 and empty bobbin 129 are transferred between the spinning machine and winder as they are fitted on and erected on the trays 112, as shown in FIG. 6. Also, the spinning bobbin transfer passages 103, 104 and 105 and the empty bobbin transfer passages 106, 107 and 108 include conveyor belts 113 and guide plates 114, 114 for the trays 112.

Figure 7:
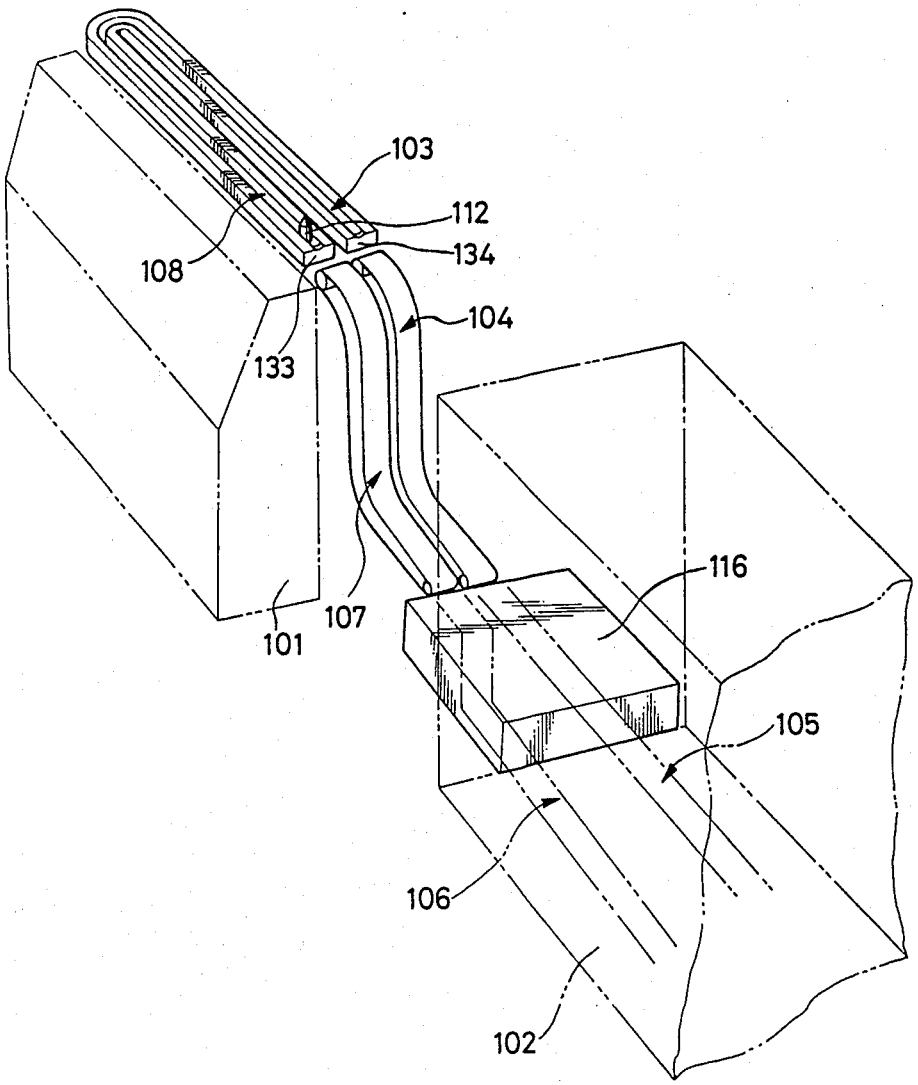
FIG. 7 is a schematic view of the portion connecting the spinning machine with the winder.

It is necessary that the spacing between the trays in the spinning bobbin transfer passages 103 and 108 be substantially the same as that of the spindles 115. Thus, instead of the conveyors in this particular embodiment, a tray fowarder mechanism may be employed, as shown in FIG. 7, which transfers the trays in a stepping manner along plane plates 133 and 134. In this modification, it is necessary that the inclined transfer passages 104 and 107 be spaced from the transfer passages 103 and 108 that are installed at a level raised from the floor by a distance H, as shown in FIG. 7. In a bobbin transfer system having conveyor means as the ones 113, 113 in FIG. 6, the bobbin transfer passages 103, 104 and 105 may be a single train of conveyor belt.

Referring back to FIG. 5, a preparatory station 116 is provided to set a spinning bobbin ready for re-winding, and includes a conventional yarn finding device 117, which is mounted in the spinning bobbin transfer passage 105, to find the end of the yarn in the spinning bobbin. Also, the preparatory station 116 includes a bypass 118 to bring into the yarn end finding device 117 again bobbins with residual yarns discharged from the winder. Also, a residual yarn remover 119 is provided in the empty bobbin transfer passage 106 to remove a extremely small amount of yarn which remains on a bobbin and is impossible to be re-wound.

The operation of the transfer system having the above-mentioned arrangement will be described. In operation, empty bobbins are held to be erected on their respective trays 12 in the empty bobbin transfer passage 108 at spaced locations opposite to the spindles 115. Also, the spinning bobbin transfer passage 103 carries thereon empty trays 112 at spaced locations opposite to the spindles 115. When a bobbin 124*a* is finished with winding on its spindle 115, doffing is started, with the winding stopped, either by a doffer or by an operator. This doffing consists in taking the full wound bobbin 124*a* from the spindle 115, standing it on an empty tray 112 in the spinning bobbin transfer passage, and, after re-winding is completed, the bobbin now as an empty bobbin 129 is ejected onto the empty bobbin transfer passage 108 where it is carried on the spindle 115.

After doffing, the empty trays in the empty bobbin transfer passage 108 all stand without bobbins while the spinning bobbin transfer passage 103 has a row of spinning bobbins. With the system in this position, when a signal comes from the winder to demand for spinning bobbins, the one at the leading end of the queue of the spinning bobbins is forwarded through the inclinded transfer passage 104 to the preparatory station 116 on the side of the winder. Also, each time an empty bobbin returned from the winder is fed onto empty bobbin transfer passage 108, the empty tray at the rightmost end of the transfer passage 108, as can best be shown in FIG. 5, is caused to turn around into the spinning bobbin transfer passage 103 so that the empty bobbins and the empty trays come to stand, with their spacing being the same as the spindles, ready for subsequent doffing.

In addition, every spinning bobbin discharged from the spinning bobbin transfer passage 103 is forwarded on the inclinded transfer passage 104, and then is continued on through the transfer passage 105 in the preparatory station 116 before the end of the yarn is found from the bobbin for subsequent winding at a winding unit in the winder in the manner explained above.

It will be appreciated from the above that the bobbin transfer system according to this embodiment, because of the design that separate transfer passages for spinning and empty bobbins, respectively, are mounted at a top portion of the spinning machine for connection with transfer passages on the side of the winder through inclined transfer passages, can eliminate the provision of bobbin transfer passages in the vicinity of the spindles, thereby making it possible to make the transfer space smaller on the side of the spinning machine. Also, since the bobbins to be transferred are proper spaced away from the spindles, the operator can have easy maintenance access to the spindles and the draft zone.

The present invention further proposes a system in which a spinning machine with a single row of spindles is divided into a number of discrete spinning units, each capable of spinning a separate kind of yarns so that the machine can produce various kinds of yarns on the whole. Bobbin transfer passages are installed in the same number as the kinds of the yarns to be produced and supply spinning bobbins from their end as required by the winder. The opposite end of each bobbin transfer passage is supplied with empty bobbins for the same kind of yarn.

Embodiments of the above system will be described in full detail in conjunction with the accompanying drawings.

Figure 8:
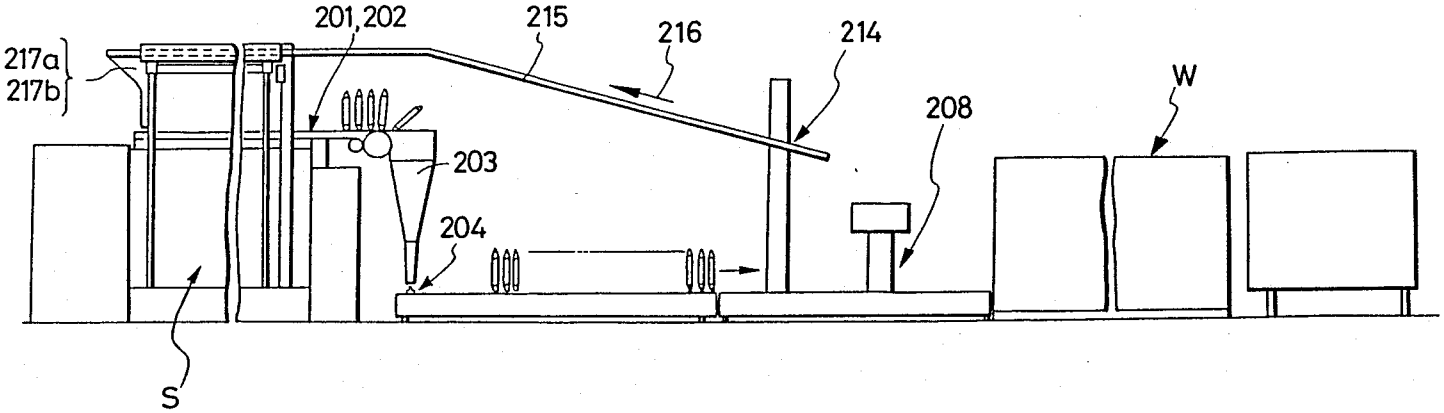
FIG. 8 is a front view showing still another embodiment of the present invention.
Figure 9:
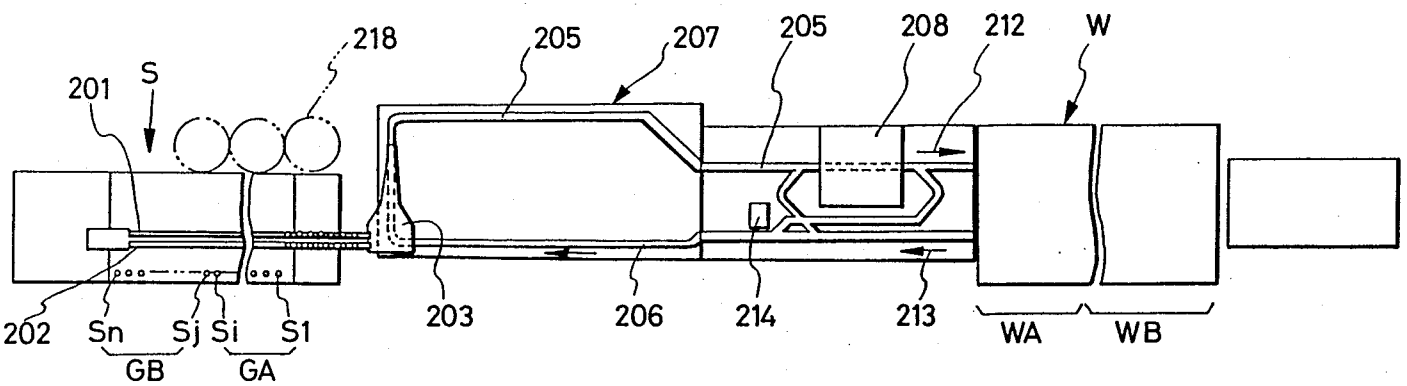
FIG. 9 is a plan view of the embodiment of FIG. 8.

FIGS. 8 and 9 show a preferred embodiment of the spinning winder constructed in accordance with the above system. A spinning machine S is of a type having a longitudinal row of spindles S1, S2, . . . , Sn installed on one side of the machine base. In this particular embodiment, the spindles are divided into two discrete groups GA and GB of spindles. With this arrangement, the spindles S1, S2, . . . , Si of the group A produces a first kind of yarn A while the spindles Sj, Sk, . . . Sn manufacturing a second kind of yarn B.

Likewise, the winder portion W is also divided into two discrete winding units WA and WB, each being adapted to winding a separate kind of yarn. The type disclosed in laid-open Japanese patent application No. 60-48 871 may be employed for this purpose. Those conventional winders having magazines may also be employed.

In addition, the spinning machine is provided with two transportation passages 201 and 202 each consisting of a transport band and that are mounted to run along the spindle row. Each band is an endless band and carries therein a row of equally spaced pegs whose spacing is the same as the spindles. At the end of each transport band where the spinning bobbins are supplied is installed a bobbin chute 203 through which bobbins are allowed to drop onto a tray 204 in the bobbin transfer passage below.

Also, a pair of spinning bobbin transfer passage 205 and empty bobbin transfer passage 206 are mounted to run between the spinning machine S and the winder W. Also, a buffer line 207 for temporarily storing bobbins and a preparatory station 208 where the spinning bobbin has the end of its yarn to be found, are mounted at locations along the spinning bobbin transfer passage 205. With this arrangement, when the tray is loaded with a bobbin with yarn of kind A or B, the tray is caused to move along the transfer passage 205 to the preparatory station 208 where the end of the yarn from the bobbin is found for winding, then continuing on in the passage in the direction of the arrow 212 to the winder W. A steam set station may possibly be installed in the buffer line 207.

On the other hand, when an empty bobbin is discharged by the winder W, it is carried along the transfer passage to move in the direction of the arrow 213 to a take-up station where it is taken up by conventional take-up means. The empty bobbin is further conveyed in the direction of the arrow 216 by an overhead conveyor 215 to the rear end of the spinning machine opposite to the end of the winder portion where spinning bobbins are discharged. The empty bobbin is then supplied through chutes 217*a* and 217*b* onto the transport band from which a spinning bobbin is discharged. The numeral 218 designates a sliver can.

Figure 10:
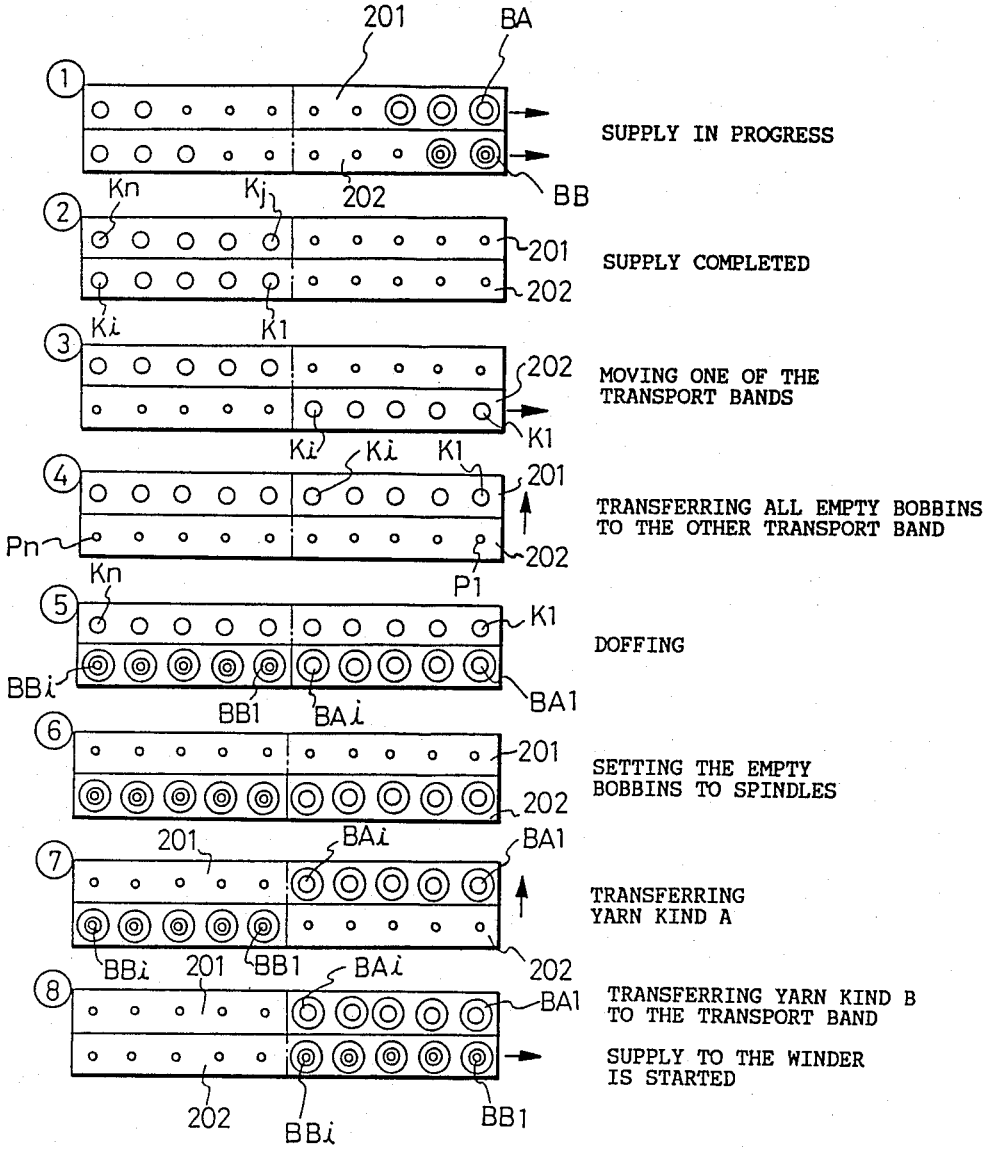
FIG. 10 is a chart showing the processing of bobbins on the spinning machine of this embodiment.

How the bobbin is treated on the spinning winder of the above embodiment will be described in conjunction with FIG. 10.

At Step 1 in the chart of FIG. 1, a spinning bobbin BA, BB is supplied at the request of the winder. It is now assumed that there is a spinning bobbin BA with a yarn of kind A is put in the transport band 201, hereinafter referred to as a "band", while a spinning bobbin BB of a yarn of kind B being placed in the band 202. When the band 201 rotates to put forth the spinning bobbin Ba of yarn kind A from the position depicted in the figure, an empty peg emerges at an empty bobbin supply position 217*a* at the other end where an empty bobbin, which may be applicable to yarns of both kinds A and B returned back from the winder portion, are set on the peg. Thus, at the moment when the supply of spinning bobbins to the bands 201 and 202 is completed, empty bobbins kj, kk, . . . , kn are lined to occupy the left half of the band 201 while empty bobbins k1, k2, . . . , ki being arrayed in the left half of the band 202, as shown by Step 2.

The band 202 alone is then moved in such a manner to move the empty bobbins k1, k2, . . . , ki into the right half of the band 202 (Step 3). Thereafter, the empty bobbins k1, k2, . . . , ki on the band 202 are set on empty pegs in the band 201 through a chuck arm, not shown (Step 4).

With the empty bobbins in this position, the machine is set ready for doffing. When the spinning machine has spun yarns of kinds A and B to produce spinning bobbins BA1, BA2, . . . , BAi and BB1, BB2, . . . , BBi, they are set on empty pegs P1, P2, . . . , Pn in the band 201 (Step 5), and then the empty bobbins, K1, K2, Kn in the band 201 are installed on the spindles corresponding thereto (Step 6).

The spinning bobbins BA1, BA2, . . . , BAi of yarn kind A in the right half of the band 202 are transferred to empty pegs in the band 201 (Step 7), and the band 202 is revolved to transfer the spinning bobbins BB1, BB2, . . . , BBi of yarn kind B in its left half into the side from which they are discharged (Step 8), completing the preparation of supply of bobbins to the winder.

In this manner, the supply of bobbins of both yarn kinds A and B can be achieved at the request of the winder without any delay.

Discrimination of yarn kinds at the winder may be achieved through various know methods. For example, the trays may be provided with a discriminating groove or colored with a different color for each yarn kind, or labeled with a re-writable magnetic material in which a yarn kind is marked.

Although the above description is made as to a spinning machine capable of producing two kinds of yarns, it is to be understood that the preferred embodiment is given by way of illustration and that the present invention should not be limited to it, but also applicable to machines capable of producing more than two kinds of yarns, with the corresponding addition of transport bands to cope with the number of yarn kinds produced.

Furthermore, although the transport bands 201 and 202 are described as they are mounted at a top portion of the spinning machine in the preferred embodiment, they may alternatively be mounted at a lower portion at the same level of the bobbin transfer passages in the winder portion so as to enable the transposition of spinning bobbins from the band directly onto the trays set ready for winding in a modified form of the embodiment.

It will be appreciated from the above that the spinning machine can be operatively connected to a winder capable of treating various kinds of yarns at one time, even if the machine is of the type having a single row of spindles.

It will be appreciated from the above that the bobbin transfer system according to the present invention can spare floor space for the transfer of bobbins because of the design that a pair of conveyors for spinning and empty bobbins are mounted on a top part of the fine spinning machine. Also, the system of this invention can provide easy access to the draw-out rollers and the spindles for the operator because of the arrangement that offers clear view of the thread guides in the spindles.

What is claimed is:

1. A bobbin transfer system operable with a plurality of bobbin transfer trays, said system comprising a pair of conveyors to carry spinning and empty bobbins, respectively, each installed at a top position of a spinning machine to run along a row of spindles, wherein the spinning machine is connected with a winder and a chute installed at a winder-side end of the spinning bobbin conveyor is provided to receive spinning bobbins from the spinning bobbin conveyor and to transfer them to the bobbin transfer trays, and wherein the empty bobbin conveyor includes, at a winder-side end thereof, an inclined portion that extends downwardly from the conveyor to a point where the conveyor receives empty bobbins.

2. The bobbin transfer system as claimed in claim 1, wherein the spinning bobbin conveyor is provided with a peg operable for receiving one of the spinning bobbins, and wherein said chute has a receiving port opened at a top end thereof that is so situated with respect to the point of turning of the spinning bobbin conveyor that the spinning bobbin falls straight into the receiving port as it is unloaded from the peg, and a pair of bobbin guides are mounted below an exit port opened at a bottom end of the chute and adapted to open in a direction perpendicular to the direction to which the tray transfers a bobbin.

3. A bobbin transfer system comprising a closed loop for transferring bobbins between a spinning machine and a winder, the closed loop comprising first and second spinning bobbin transfer passages and first and second empty bobbin transfer passages, the first spinning bobbin transfer passage and the first empty bobbin transfer passage being mounted at a top portion of the spinning machine.

4. The bobbin transfer system as claimed in claim 3, wherein said first spinning bobbin transfer passage and said first empty bobbin transfer passage are connected to each other at one end of the spinning machine while at an opposite winder-side end of the spinning machine said first empty bobbin transfer passage is joined to an upper end of said second empty bobbin transfer passage that is inclined downward, and said first spinning bobbin transfer passage is connected to an upper end of a second spinning bobbin transfer passage that is inclined downward.

5. The bobbin transfer system as claimed in claim 4, further comprising a third spinning bobbin transfer passage and a third empty bobbin transfer passage which extend in the region of the winder along a row of winding units at a level above a floor, the third spinning bobbin transfer passage is joined to the lower end of the inclined second spinning bobbin transfer passage, the third empty bobbin transfer passage is connected to the lower end of the inclined second empty bobbin transfer passage, and a closed loop is formed with the bobbin transfer passages, empty bobbin transfer passages and passages provided in each spinning unit.

6. A spinning machine having on one side thereof a row of spindles, said spinning machines being essentially divided into a predetermined number of discrete units each adapted for producing a separate kind of yarn, said spinning machine comprising a predetermined number of bobbin transfer passages for transferring bobbins, said predetermined number of bobbin transfer passages being equal in number to said predetermined number of discrete units, each of said bobbin transfer passages being arranged to run along the row of spindles.

7. The spinning machine as claimed in claim 6, wherein said bobbin transfer passages are installed at a top portion of the spinning machine to run along a row of spindles.

8. The spinning machine as claimed in claim 7, wherein each transfer passage has an end and wherein first bobbin chutes are provided at the end of each transfer passage to discharge the bobbin and to drop the bobbin onto a tray, and second chutes, through which empty bobbins extracted from trays and transferred by an overhead conveyor are supplied onto the transfer passage from which a spinning bobbin is discharged, are located at the opposite end of the winder portion where spinning bobbins are discharged.

9. A bobbin transfer method for a spinning machine carrying on one side thereof a row of spinning machine spindles, wherein said row of spinning machine spindles is divided into a number of discrete spinning units, each capable of spinning a separate kind of yarn so that the machine can produce various kinds of yarns on the whole, said method comprising the steps of:

supplying spinning bobbins to a winder on a plurality of bobbin transfer passages, said plurality of bobbin transfer passages having the same number of transfer passages as the kinds of the yarns to be produce; and supplying empty bobbins to each bobbin transfer passage.

10. A bobbin transfer device for transferring spinning bobbins and empty bobbins between a spinning machine having a plurality of spindles and a winder, said bobbin transfer device comprising:

spinning bobbin transfer means for transferring spinning bobbins from the spinning machine to the winder, said spinning bobbin transferring means having first and second conveying means, said first conveying means, being arranged above the spindles, for conveying spinning bobbins to said second conveying means, said second conveying means for conveying spinning bobbins from said first conveying means to the winder; and empty bobbin transfer means for transferring empty bobbins from the winder to the spinning machine, said empty bobbin transfer means having third and fourth conveying means, said third conveying means for conveying empty bobbins from the winder to said fourth conveying means, said fourth conveying means, being arranged above the spindles, for conveying empty bobbins.

11. A bobbin transfer device as claimed in claim 10, wherein:

said first and fourth conveying means each comprise a movable passage arranged above and along the plurality of spindles.

12. A bobbin transfer device as claimed in claim 10, wherein said second conveying means comprises first transportation means for transporting spinning bobbins to the winder and first connecting means for connecting said first conveying means with said first transportation means; and said third conveying means comprises and transportation means for transporting empty bobbins from the winder and second connecting means for connecting said second transportation means with said fourth conveying means.

13. A bobbin transfer device as claimed in claim 12, wherein:

said first transportation means comprises a movable spinning bobbin passage; and said first connecting means comprises a chute having a receiving port arranged to receive spinning bobbins conveyed by said first conveying means and a delivery port arranged to deliver the received spinning bobbins to said movable spinning bobbin passage.

14. A bobbin transfer device as claimed in claim 12, wherein:

said first conveying means comprises a first movable spinning bobbin passage having a first end operatively connected with said fourth conveying means and a second end operatively connected with said first connecting means;

said fourth conveying means comprises a first movable empty bobbin passage having a first end operatively connected with said first movable spinning bobbin passage and a second end operatively connected with said second connecting means;

said first transportation means comprises a second movable spinning bobbin passage;

said second transportation means comprises a second movable empty bobbin passage; and said first and second connecting means comprise first and second inclined movable passages, respectively.

15. A method of operating first and second transport bands to transfer spinning bobbins of a first type, spinning bobbins of a second type and empty bobbins between a plurality of spinning machine spindles and a winder, said method comprising the steps of:

supplying a plurality of empty bobbins to the first transport band;

transferring a plurality of spinning bobbins from a corresponding plurality of spindles to the second transport band, said plurality of spinning bobbins comprising at least one spinning bobbin of the first type and at least one spinning bobbin of the second type;

transferring the plurality of empty bobbins from the first transport band to a corresponding plurality of spindles;

transferring said at least one spinning bobbin of the first type from the second transport band to the first transport band;

transferring spinning bobbins of the first and second types to the winder from the first and second transport bands, respectively.

16. A method as claimed in claim 15, wherein the plurality of spinning bobbin spindles includes at least one spindle for producing a spinning bobbin of the first type and at least one spindle for producing a spinning bobbin of the second type, wherein the first and second transport bands each have a first section and a second section, and wherein said step for transferring a plurality of spinning bobbins to the second transport band comprises transferring each spinning bobbin of the second type to the first section of the second transport band and transferring each spinning bobbin of the first type to the second section of the second transport band.

17. A method as claimed in claim 16, wherein said step of transferring said at least one spinning bobbin of the first type comprises transferring each spinning bobbin of the first type from the second transport band to the second section of the first transport band.

18. A method as claimed in claim 17, further comprising the step of moving at least one of the first and second transport bands to align the second section of the first transport band with the first section of the second transport band.

19. A method as claimed in claim 15, wherein the first and second transport bands are arranged above the plurality of spinning machine spindles and are operatively connected with a bobbin conveying means for conveying spinning bobbins to the winder, and wherein said step of transferring spinning bobbins of the first and second types to the winder comprises the step of transferring spinning bobbins from the first and second transport bands to the bobbin conveying means.

20. A method as claimed in claim 19, wherein the conveying means comprises:

a bobbin transfer passage arranged between the winder and the first and second transport bands; and a bobbin chute having an input port arranged at an end of each of the first and second transport bands and an output port arranged adjacent the bobbin transfer passage.

* * * * *